US005753351A

United States Patent [19]

Yoshida et al.

[11] Patent Number: 5,753,351

[45] Date of Patent: May 19, 1998

[54] NUBUCK-LIKE WOVEN FABRIC AND METHOD OF PRODUCING SAME

[75] Inventors: Norio Yoshida; Kojiro Shimada; Fumio Shibata; Seiji Tachika, all of Osaka, Japan

[73] Assignee: Teijin Limited, Osaka, Japan

[21] Appl. No.: 676,245

[22] PCT Filed: Nov. 17, 1995

[86] PCT No.: PCT/JP95/02358

§ 371 Date: Oct. 16, 1996

§ 102(e) Date: Oct. 16, 1996

[87] PCT Pub. No.: WO96/16212

PCT Pub. Date: May 30, 1996

[30] Foreign Application Priority Data

Nov. 18, 1996 [JP] Japan ..... 6-284960

[51] Int. Cl.[6] ..... D03D 15/00; D06C 11/00; D06C 27/00; D02G 3/04

[52] U.S. Cl. ..... 428/196; 26/18.5; 28/168; 28/169; 139/420 A; 428/91; 428/207; 442/60; 442/199; 442/200; 442/201; 57/224; 57/244; 57/245

[58] Field of Search ..... 26/18.5, 29 R; 139/420 A; 428/91, 196, 207; 442/60, 199, 200, 201; 28/168, 169

[56] References Cited

U.S. PATENT DOCUMENTS

| | | |
|---|---|---|
| 4,233,355 | 11/1980 | Sato . |
| 4,239,720 | 12/1980 | Gerlach et al. . |
| 4,318,949 | 3/1982 | Okamoto et al. . |
| 4,381,335 | 4/1983 | Okamoto . |
| 4,390,572 | 6/1983 | Okamoto et al. . |
| 4,460,649 | 7/1984 | Parls et al. . |
| 4,476,186 | 10/1984 | Kato et al. . |
| 4,496,619 | 1/1985 | Okamoto . |
| 5,047,189 | 9/1991 | Lin . |
| 5,124,194 | 6/1992 | Kawano . |
| 5,290,626 | 3/1994 | Nishio et al. . |

FOREIGN PATENT DOCUMENTS

| | | |
|---|---|---|
| 2-145857 | 6/1990 | Japan . |
| 5-44137 | 2/1993 | Japan . |
| 7-126951 | 5/1995 | Japan . |

*Primary Examiner*—James C. Cannon

*Attorney, Agent, or Firm*—Finnegan, Henderson, Farabow, Garrett & Dunner

[57] ABSTRACT

A nubuck-like woven fabric comprising a two-layered structural yarn wherein ultra-fine polyester multifilaments are primarily disposed in a sheath portion and polyester multifilaments having a larger single fiber thickness are primarily disposed in a core portion, and having an apparent specific gravity of 0.35–0.7 and a shear rigidity of 0.5–1.2 gf/cm·deg. This woven fabric is produced by a method wherein a woven fabric of a two-layered structural yarn composed of (i) side-by-side type or islands-in-sea type composite multifilaments comprising (a) a readily soluble ingredient and (b) ultra-fine multifilaments-forming ingredient and (ii) highly shrinkable multifilaments, is subjected to a treatment for dissolving and removing ingredient (a) without substantial shrinkage of the two-layered structural yarn, then, the woven fabric is shrunk in a widespread state.

11 Claims, 4 Drawing Sheets

NUBUCK-LIKE WOVEN FABRIC AND METHOD OF PRODUCING SAME

TECHNICAL FIELD

This invention relates to a nubuck-like woven fabric and a method of producing the nubuck-like woven fabric. More particularly, it relates to a nubuck-like woven fabric which is uniform and is of a close and tight texture, and has soft feeling and soft surface touch, and a method of producing the nubuck-like woven fabric without use of a urethane resin.

BACKGROUND ART

As a method of producing a raised woven fabric of a suade type or a nubuck type, a method has been generally employed wherein a woven fabric or nonwoven fabric comprising ultra-fine filaments is impregnated with a urethane resin and then is subjected to a raising or buffing treatment so that the ultra-fine filaments appear on the surface of the fabric.

The urethane resin is used for imparting a close and tight texture to the fabric, but the use thereof invites a problem such that the feeling of the fabric becomes stiff, a dyed fabric thereof has a poor light fastness and, when ironed, the dye migrates and consequently contaminates other fabrics.

To cope with the above problem, a method for producing a suede-like fabric without use of a urethane resin has been proposed. Namely, in Japanese Unexamined Patent Publication (JP-A) 5-44137, a method is described wherein a fabric made of a composite filament yarn composed of (i) a polyester/polyamide composite filament capable of forming ultra-fine filaments when the composite filament is divided into the respective filaments, and (ii) a polyester multifilament having a boiling water shrinkage of at least 25%, is subjected to a shrinking treatment under conditions such that the surface of the fabric shrinks by 30% or more, and then, the polyester/polyamide composite filament is partly dissolved out to form ultra-fine filaments. In Japanese Unexamined Patent Publication (JP-A) 7-126951, a commingled multifilament yarn composed of (i) dividable composite multifilament yarn capable of forming ultra-fine filaments and (ii) a highly shrinkable multifilament yarn having a large denier, is woven or knitted into a fabric, and then the fabric is subjected to a heat-treatment and a dividing treatment to form a fabric having a soft surface touch and a tight texture.

By the above-mentioned methods, a natural suede-like feeling can be imparted to the fabric without use of a urethane resin. However, shrinkage of the fabric occurs before the composite filament is partly dissolved out in the method of JP-A 5-44137 and approximately simultaneously with partial dissolution of the composite filament in the method of JP-A 7-126951, and therefore, the filaments located in the core in the composite yarn constituting the fabric are adhered to each other by the thermal shrinkage. This adhesion of the filaments is an obstacle to penetration of a solvent for dissolution into the fabric and circulation of the solvent, and a considerable amount of undivided composite filaments remain in the fabric. Consequently, the fabric does not have a close and tight texture (i.e., the filaments are fastened together only to an insufficient extent), the surface touch becomes stiff, and, when dyed, uneven dyeing occurs.

In JP-A 2-145857, a process for producing a high density woven or knitted fabric is described wherein a woven or knitted fabric made of a polyester/polyamide composite filament is subjected to a dissolution treatment for dissolving and removing 5 to 50% by weight of the polyester without shrinkage of the fabric, whereby interstices are formed among the polyesters and the polyamides, and then the fabric is subjected to a crease-flexing treatment while the fabric is thermally shrunk at a temperature of at least 80° C. whereby the polyester/polyamide composite filament is divided into ultra-fine polyester filaments and polyamide filaments by the difference in thermal shrinkage.

However, in the above-mentioned process, only a limited part of the filaments constituting the composite filaments are dissolved for the formation of the two kinds of ultra-fine filaments, and thus, interstices formed among the filaments are minor. When the fabric is heat-shrunk, the shrinkage is minor, and thus the fabric is of a close and tight texture only to a lesser extent than that attained in the conventional method including the step of impregnation with a urethane resin. Further, in the above-mentioned process, when the fabric is subjected to a crease-flex treatment while being heat-shrunk, the fabric is subject to the heating action and the crease-flexing action simultaneously, and therefore, strain due to the crease-flexing action remains in the final fabric. This residual strain leads to occurrence of creases, stiffening of the touch and feeling, and reduction of quality.

DISCLOSURE OF INVENTION

An object of the invention is to obviate the above-mentioned problems of the conventional techniques and to provide a nubuck-like woven fabric which is uniform and of a close and tight texture, and has soft feeling and surface touch.

Another object of the present invention is to provide a method of producing the nubuck-like woven fabric without impregnation of a urethane resin.

To achieve the above objects, the inventors have pursued researches and found that a woven fabric having a natural nubuck-like feeling can be obtained by a method wherein a woven fabric comprising a two-layered structural yarn made of (i) composite multifilaments comprised of (a) a readily soluble ingredient and (b) an ingredient capable of forming ultra-fine polyester multifilaments and (ii) highly shrinkable multifilaments is subjected to a partial dissolution treatment for dissolving the readily soluble ingredient (a) without substantial shrinkage of the fabric to remove the ingredient (a) and form ultra-fine multifilaments on the surface of the fabric, and then the woven fabric is subjecetd to a shrinking treatment in a widespread state, whereby the ultra-fine multifilaments on the surface of the fabric are fastened together into a high density.

Thus, in accordance with the present invention, there is provided a nubuck-like woven fabric comprising a two-layered structural yarn wherein ultra-fine polyester multifilaments having a single fiber thickness of 0.001 to 0.5 denier are primarily disposed in a sheath portion and polyester multifilaments having a single fiber thickness larger than that of the ultra-fine polyester multifilaments are primarily disposed in a core portion; said woven fabric satisfying the following two requirements (1) and (2):

(1) the woven fabric has an apparent specific gravity B of 0.35 to 0.7 as calculated by the following formula from the weight per unit area W (g/m$^2$) and thickness t (mm) of the woven fabric which are measured as follows according to JIS-L 1096–1990:

$$B=W/(1{,}000\times t)$$

wherein the weight per unit area W (g/m$^2$) of the woven fabric is determined by weighing the weight (g) of three specimens each having a size of 20 cm×20 cm at a temperature of 20°±2° C. and a relative humidity of 65±2%, and the average weight is expressed in terms of a value per $m^2$, and the thickness t (mm) of the woven fabric is determined by measuring the thickness (mm) using a thickness meter on five locations of each specimen under an initial load of 7 $gf/cm^2$ at a temperature of 20°±2° C. and a relative humidity of 65±2% and expressing the average thickness in mm; and (2) the woven fabric has a shear rigidity G of 0.2 to 1.5 gf/cm·deg as measured by the shearing testing method according to KES (Kawabata Evaluation System).

In accordance with the present invention, there is further provided a method of producing a nubuck-like woven fabric characterized in that:

(1) a woven fabric comprising a two-layered structural yarn prepared by commingling (i) side-by-side type composite multifilaments and/or islands-in-sea type composite multifilaments comprising (a) a readily soluble ingredient and (b) an ingredient having a solubility smaller than that of ingredient (a) and capable of forming ultra-fine polyester multifilaments, together with (ii) highly shrinkable polyester multifilaments having a thermal shrinkage larger than that of the composite multifilaments (i), is subjected to a partial dissolution treatment for dissolving the readily soluble ingredient (a) without substantial shrinkage of the two-layered structural yarn thereby to remove the ingredient (a) from the composite multifilaments (i) whereby ultra-fine polyester multifilaments with a flat cross-section are formed; and then, (2) the thus-treated woven fabric is subjected to a shrinking treatment in a widespread state.

BEST MODE FOR CARRYING OUT THE INVENTION

The present invention will now be described in detail.

Figure 3:
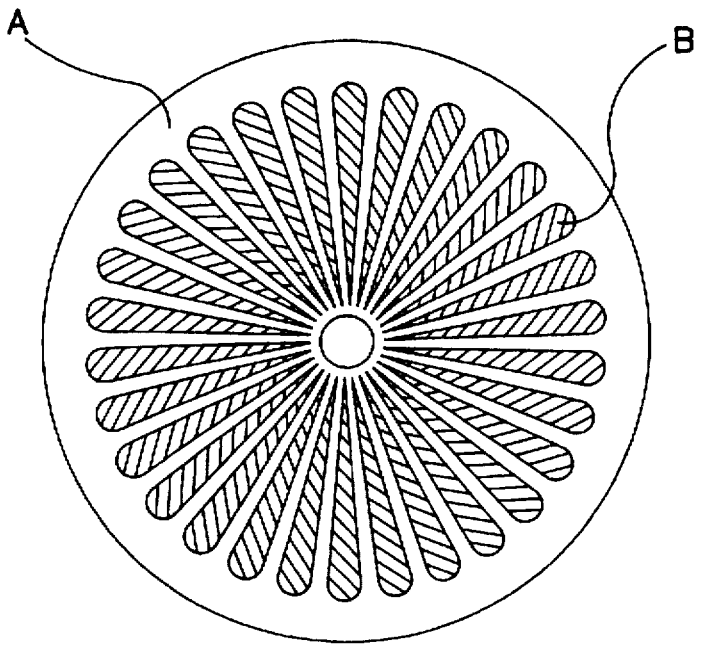
FIG. 3 is a cross-section diagrammatically showing an example of a cross-section of a side-by-side type composite filament.
Figure 4:
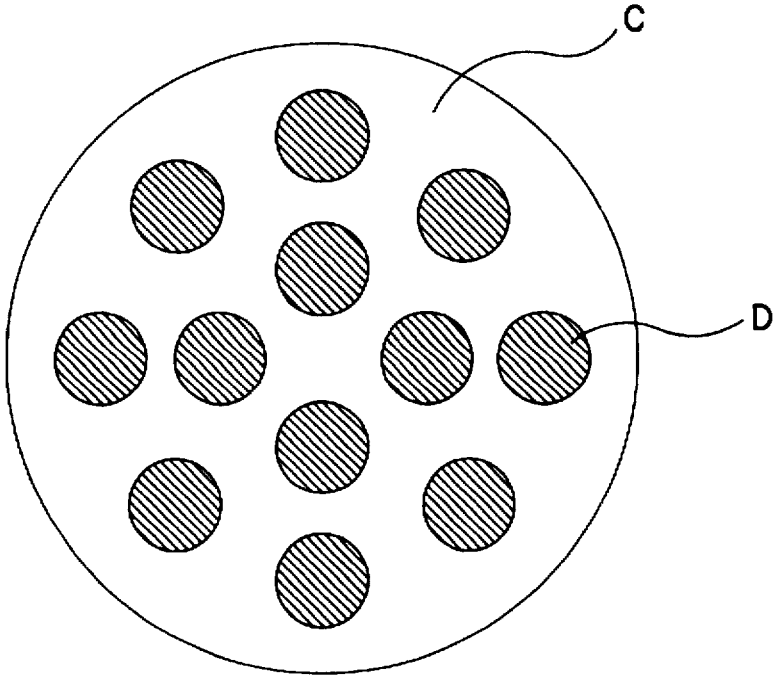
FIG. 4 is a cross-section diagrammatically showing an example of a cross-section of an islands-in-sea type composite filament.

The composite filaments used in the present invention are comprised of (a) a readily soluble ingredient and (b) an ingredient having a solubility smaller than that of ingredient (a) and capable of forming ultra-fine polyester multifilaments. The composite filaments are side-by-side type composite filaments as illustrated in FIG. 3 wherein, in the cross-section of the filaments, an ingredient B is divided into a plurality of filaments by another ingredient A, or the composite filaments are islands-in-sea type composite filaments as illustrated in FIG. 4 which are composed of a sea ingredient C and an island ingredient D. At least one of the two ingredients A and B in the side-by-side type composite filaments is composed of polyester and island ingredient D in the islands-in-sea type composite filaments is also composed of polyester.

Either ingredient A or ingredient B in the side-by-side type composite filaments shown in FIG. 3 is readily soluble, and, by dissolving the readily soluble ingredient A or B out from the composite filaments, ultra-fine polyester multifilaments composed of the other ingredient B or A are formed.

Sea ingredient C in the islands-in-sea type composite filaments illustrated in FIG. 4 is readily soluble, and, by dissolving sea ingredient C out from the composite filaments, ultra-fine polyester multifilaments composed of island ingredient D are formed.

As specific examples of the readily soluble ingredient in the composite filaments, there can be mentioned nylon-6, polystyrene, a polyester having copolymerized therein 5-sodium-sulfoisophthalic acid ingredient, a polyester having incorporated therein a polyoxyalkylene glycol ingredient, and a polyester having incorporated therein a polyether ester composed of a dicarboxylic acid ingredient and a polyoxyalkylene glycol ingredient. As specific examples of the ultra-fine polyester multifilament-forming ingredient in the composite filaments, there can be mentioned a polyester predominantly comprised of ethylene terephthalate units and a polyester predominantly comprised of butylene terephthalate units.

The particular combination of ingredients A and B and the ratio A/B in the side-by-side type composite filaments illustrated in FIG. 3, and the particular combination of ingredients C and D and the ratio C/D in the islands-in-sea type composite filaments illustrated in FIG. 3, can be appropriately determined depending upon, for example, the desired thickness of the ultra-fine polyester multifilaments and the conditions under which the readily soluble ingredients are dissolved.

Among the side-by-side type composite filaments and the islands-in-sea type composite filaments, a side-by-side type composite filament is preferable which is composed of 50% by weight of a polyether-ester derived from a dicarboxylic acid ingredient and a polyoxyalkylene glycol ingredient as ingredient (a) (i.e., readily soluble ingredient) and 50% by weight of a polyester predominantly comprised of ethylene terephthalate units as ingredient (b) (i.e., ultra-fine polyester multifilament-forming ingredient).

The ultra-fine polyester multifilaments formed by dissolving the readily soluble ingredient out of the composite filament must have a single fiber thickness of 0.001 to 0.5 denier. A preferable single fiber thickness is 0.01 to 0.1 denier. If the single fiber thickness is larger than 0.5 denier, the fabric does not have a close and tight texture and the feeling and surface touch of the fabric are not soft. In contrast, if the single fiber thickness is smaller than 0.001 denier, the feeling and surface touch of the fabric is too soft, and the fabric does not have an appropriate stiffness and is apt to be limp, and its durability is deteriorated.

The ultra-fine polyester multifilaments preferably have a cross-section such that flatness thereof is in the range of 8 to 15. By the term "flatness" used herein we mean the ratio of the maximum length/the maximum width in the cross-sectional shape of filament, i.e., the ratio of the maximum width/the maximum thickness of filament. When the cross-sectional shape is ellipse, the flatness means the ratio of long diameter/short diameter. When the cross-sectional shape is rectangular, the flatness means the ratio of long side/short side.

The ultra-fine flat polyester multifilaments can easily be made by constituting, for example, the side-by-side composite filaments so that the ingredient capable of forming the ultra-fine flat polyester multifilaments, i.e., the ingredient which is not readily soluble, is composed of a multiplicity of flat-shaped fractions in the cross-section.

The highly shrinkable polyester multifilaments having a thermal shrinkage larger than the composite filaments can be made by a conventional procedure, for example, by drawing an undrawn polyester multifilament yarn at a low temperature and a low drawing ratio. Preferably the highly shrinkable polyester multifilaments are made of a polyester having copolymerized therein a third ingredient such as isophthalic acid.

The highly shrinkable polyester multifilaments preferably have a boiling water shrinkage of at least about 20% to allow the fabric to shrink to a satisfying extent and impart a close and tight texture and a soft surface touch and feeling to the fabric. However, when the boiling water shrinkage is too large, uneven shrinking is apt to occur, and therefore, the boiling water shrinkage should preferably be not larger than about 70%.

The highly shrinkable polyester multifilaments must have a single fiber thickness larger than that of the ultra-fine polyester multifilaments, and preferably has a single fiber thickness of 1 to 5 denier, more preferably 2 to 4 denier.

The woven fabric of the present invention comprises a two-layered structural yarn comprised of ultra-fine polyester multifilaments and highly shrinkable polyester multifilaments. This two-layered structural yarn is made by a procedure wherein side-by-side type composite filaments and/or islands-in-sea type composite multifilaments and the highly shrinkable polyester multifilaments are paralleled and commingled together by twisting together, air-jetting entanglement or false-twisting simultaneously with drawing, followed by dissolution of the readily soluble ingredients of the composite filaments. Where the two-layered structural yarn is made, there is preferably provided a feed rate difference or an elongation difference between the composite multifilaments and the highly shrinkable polyester multifilaments so that the highly shrinkable polyester multifilaments are disposed predominantly in a core portion and the composite polyester multifilaments are disposed predominantly in a sheath portion. It is especially preferable to employ a procedure wherein highly shrinkable polyester multifilaments and side-by-side type and/or islands-in-sea type composite multifilaments having an elongation larger than that of the highly shrinkable polyester multifilaments are subjected to air-jetting entanglement and then subjected to false-twisting simultaneously with drawing. This procedure results in a two-layered structural yarn wherein little or no slippage occurs between the core filaments and the sheath filaments.

The woven fabric of the present invention is woven from the above-mentioned two-layered structural yarn by using the yarn as weft and/or warp. Preferably the two-layered structural yarn is used as both weft and warp for weaving because a woven fabric of a higher quality level can be obtained. If desired, provided that the object of the present invention is achieved, other yarns such as yarns of natural fibers, regenerated fibers and other synthetic fibers can be used for weaving in combination with the two-layered structural yarn. The weave structure employed is not particularly limited, and any weave structure including plain weave, twill weave and satin weave can be employed.

The woven fabric is subjected to a partial dissolution treatment, i.e., the readily soluble ingredient of the side-by-side type and/or islands-in-sea type composite filaments in the woven fabric is dissolved out whereby ultra-fine polyester multifilaments are formed. As a procedure for dissolving the readily soluble ingredient, there can be mentioned a procedure wherein the woven fabric is immersed in a solvent capable of dissolving the readily soluble ingredient and a procedure wherein the woven fabric is padded with a solvent capable of dissolving the readily soluble ingredient.

The partial dissolution treatment of the woven fabric must be carried out under conditions such that substantial shrinkage of the woven fabric does not occur. For this requirement, the partial dissolution treatment must be carried out at a temperature lower than the shrinkage initiation temperature Ts. By the term "shrinkage initiation temperature Ts" used herein we mean the temperature at which the areal shrinkage S is at least 10% as measured when the woven fabric is heated at a temperature elevation rate of 2° C./min for shrinkage and as defined by the following equation (I).

$$\text{Areal shrinkage } S\ (\%) = [1 - \text{surface area of fabric after heating/surface area of fabric before heating}] \times 100 \quad \text{(I)}$$

When the partial dissolution treatment is carried out at a temperature higher than the shrinkage initiation temperature, the woven fabric is shrunk to a great extent and penetration and circulation of the solvent for dissolution are insufficient. Consequently, undissolved composite filaments remain in the two-layered structural yarn constituting the woven fabric, and there is a tendency of the surface touch becoming stiff and uneven dyeing occurring. Further, when undissolved composite filaments remain in the two-layered structural yarn, the volume of vacant spaces within the woven fabric are reduced and thus, when the woven fabric is heated, the fabric is shrunk only to a minor extent and the apparent density of the fabric is too small. It is to be noted that the conventional nubuck-like woven fabric exhibited a low density of bundled ultra-fine filaments because the shrinkage of the fabric occurs simultaneously with the partial dissolution treatment of the composite filaments, and thus, undissolved composite filaments remain and the shrinkage of the woven fabric is restricted by the undissolved composite filaments.

The kind and concentration of solvent used for the partial dissolution treatment can be appropriately chosen depending upon the particular ingredients of the composite filaments and the proportion thereof. For example, in the case where the composite filaments are composed of a polyether-ester derived from a dicarboxylic acid ingredient and a polyoxyalkylene glycol ingredient as ingredient (a) (i.e., readily soluble ingredient) and a polyester predominantly comprised of ethylene terephthalate units as ingredient (b) (i.e., ultra-fine polyester multifilament-forming ingredient), an aqueous alkali solution having a concentration of 30 to 150 g/liter is preferably used.

The dissolution ratio of the readily soluble ingredient (a) is not particularly limited, but, to give a sufficient volume of vacant spaces within the woven fabric and enhance the shrinkage upon heating, it is preferable that more than 50% by weight, especially more than 80% by weight, of the readily soluble ingredient is dissolved out.

Where the partial dissolution treatment is carried out by a dipping method, the occurrence of creases due to processing should preferably be prevented or minimized by using a jig dyeing machine, an open soaper or a boiling-off machine.

After the partial dissolution treatment, the woven fabric is heat-treated under conditions such that the surface area is shrunk at a shrinkage of at least 20%, preferably at least 35%. By the term "shrinkage" used herein we mean the value S calculated from the hereinbefore mentioned equation (I). By this heat-treatment, a close and tight texture is given to the fabric, and the multifilaments constituting the two-layered structural yarn are oriented to a low degree with the result that the feeling of the woven fabric becomes soft. When the shrinkage is smaller than 20%, the woven fabric having a close and tight texture and soft feeling cannot be obtained.

The heat-treatment should be carried out in a manner such that the woven fabric is shrunk in a widespread state so that strains such as creases do not occur in the woven fabric during the heat-treatment. The heat-treatment is carried out preferably in the step of scouring, relaxing or pre-setting. To allow the woven fabric to shrink in a widespread state, a heat-treatment apparatus such as an open soaper, a boiling-off machine or a pin tenter is advantageously used. Further, a multi-vessel open soaper is more preferable because the heating temperature can be gradually elevated so that the shrinkage is appropriately controlled in each vessel.

When a circular-type dyeing machine is used for the heat-treatment, a crease-flex action is applied to the fabric during the heat-shrinking, and the strain caused by the crease-flex action remains in the final woven fabric. The resulting woven fabric has creases, a stiff feeling and a poor quality level, as well as the close and tight texture becomes deteriorated.

The heating temperature and the heating time can be chosen depending upon the desired shrinkage. Usually, the heating temperature is in the range of from (Ts+10° C.) to (Ts−50° C.) wherein Ts is shrinkage initiation temperature in °C., and the heating time is about 1 to 4 minutes.

The heat-treated woven fabric is then preferably subjected to a treatment for making the surface fluffy, for example, by buffing whereby the surface touch becomes softer. After the step of heat-shrinking the fabric, a crease-flex action may be applied to the fabric, for example, by using a circular dyeing machine whereby the multifilaments constituting the two-layered structural yarn is self-elongated and thus the fabric is softened. The fluffy woven fabric may also be subjected to a calendering treatment to enhance the uniformity of fluffs, and also a minor amount of a resin may be applied to enhance the tear strength of the woven fabric.

The nubuck-like woven fabric made by the above-mentioned method is made of polyester filaments and therefore, even though the fabric is dyed by a printing method, the printed pattern has a high uniformity and no dyeing speck, like a piece dyeing. Especially a discharge printing method wherein an original color pattern is partly discharged and thus a new color pattern is developed, is advantageously carried out because the fabric is made only of polyester filaments. If a nubuck-like woven fabric is made of two kinds of filaments, e.g., polyester filaments plus nylon filaments, or polyester filaments plus polyurethane filaments, a printed matter having a high quality level cannot be obtained, and especially when a strip-dyeing method is carried out, the color to be employed is limited.

The nubuck-like woven fabric of the prsent invention, prepared by the above-mentioned method, must satisfy the following two requirements (1) and (2):

(1) the woven fabric has an apparent specific gravity B of 0.35 to 0.7 as calculated by the following formula from the weight per unit area W (g/m$^2$) and thickness t (mm) of the woven fabric which are measured as follows according to JIS-L 1096-1990:

$$B=W/(1{,}000\times t)$$

wherein the weight per unit area W (g/m$^2$) of the woven fabric is determined by weighing the weight (g) of three specimens each having a size of 20 cm×20 cm at a temperature of 20°±2° C. and a relative humidity of 65±2%, and the average weight is expressed in terms of a value per m$^2$, and the thickness t (mm) of the woven fabric is determined by measuring the thickness (mm) using a thickness meter on five locations of each specimen under an initial load of 7 gf/cm$^2$ at a temperature of 20°±2° C. and a relative humidity of 65±2% and expressing the average thickness in mm; and (2) the woven fabric has a shear rigidity G of 0.2 to 1.5 gf/cm·deg as measured by the shearing testing method according to KES (Kawabata Evaluation System).

The apparent specific gravity B is a measure for the tightness of fastened texture, and, the larger the value of B, the more enhanced the tightness of fastened structure. If the apparent specific gravity B is smaller than 0.35, the tightness of fastened texture is poor. If the apparent specific gravity B is too large, the surface touch of the woven fabric becomes stiff, and thus, the maximum permissible B value is about 0.7. The apparent specific gravity B is preferably in the range of 0.4 to 0.6, more preferably 0.4 to 0.5.

The shear rigidity G is a measure for the pliability of the woven fabric. The smaller the shear rigitity G, the more pliable and flexible the woven fabric. If the shear rigidity G is larger than 1.5 gf/cm·deg, the fabric is stiff and the surface touch is not soft. In contrast, if the shear rigidity G is too small, the fabric becomes limp and has no rigidity. The minimum permissible shear rigidity G is about 0.2 gf/cm·deg. The shear rigidity G is preferably in the range of 0.4 to 0.9 gf/cm·deg, more preferably 0.5 to 0.7 gf/cm·deg.

In the method of producing a nubuck-like woven fabric according to the present invention, prior to the shrinkage of a fabric woven from warp and/or weft of the two-layered structural yarn comprised of (i) side-by-side type or islands-in-sea type composite multifilaments comprising (a) a readily soluble ingredient and (b) an ingredient capable of forming ultra-fine polyester multifilaments and (ii) highly shrinkable polyester multifilaments having a thermal shrinkage larger than that of the composite multifilaments (i), the readily soluble ingredient (a) of the composite multifilaments is dissolved out under conditions such that substantial shrinkage of the woven fabric does not occur. Consequently, a large volume of vacant spaces are formed within the two-layered structural yarn constituting the woven fabric, and, when the woven fabric is shrunk, the multifilaments are tightly bundled together, with the result of impartation of a close and tight texture to the woven fabric.

Further, in the present invention, ultra-fine polyester multifilaments are disposed in the sheath portion of the two-layered structural yarn, when the woven fabric is shrunk, the ultra-fine polyester multifilaments are tightly bundled together in the surface portion of the woven fabric whereby a soft surface touch is given to the woven fabric. It is to be noted that, when the woven fabric is shrunk, the multifilaments constituting the two-layered structural yarn are oriented to a low extent, and therefore, even though the filaments are bundled tightly together, the surface touch and feeling are soft.

The above-mentioned beneficial phenomena are manifested conspicuously when the ultra-fine multifilaments have a cross-sectional shape with a flatness of 8 to 15.

Figure 1:
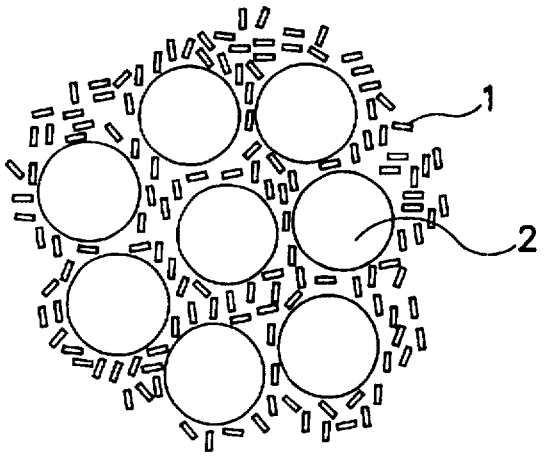
FIG. 1 is a cross-section diagrammatically showing an example of a cross-section of the nubuck-like woven fabric of the present invention.

In FIG. 1 which is a cross-section diagrammatically showing an example of part of the nubuck-like woven fabric of the present invention, ultra-fine polyester multifilaments with a flat cross-section 1 are disposed predominantly in the surface portion of the fabric and polyester multifilaments 2 having a single fiber thickness larger than that of the flat ultra-fine polyester multifilaments 1 are disposed predominantly in the center portion of the fabric. Due to this filaments distribution, the nubuck-like woven fabric has enhanced close and tight texture and soft surface touch.

Figure 2:
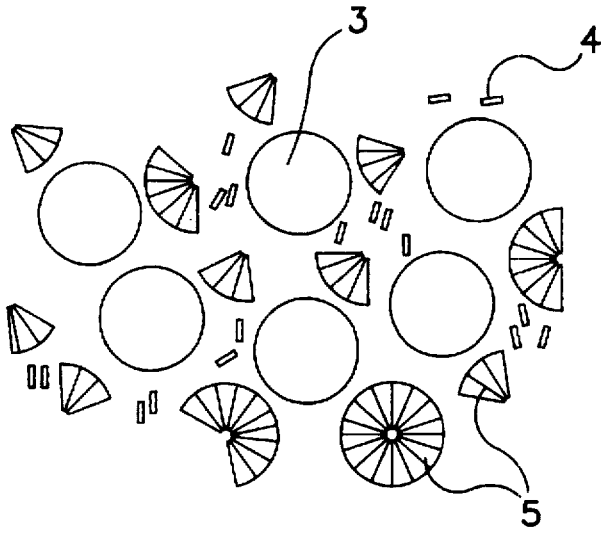
FIG. 2 is a cross-section diagrammatically showing an example of a cross-section of the conventional suede-like woven fabric which is made by a method wherein the fabric is shrunk before composite filaments are partly dissolved to form ultra-fine multifilaments.

In contrast to the woven fabric of the present invention, a conventional swede-like woven fabric having a cross-section diagrammatically shown in FIG. 2, which is made by employing a step of shrinking the woven fabric prior to the partial dissolution of the composite multifilaments as described in JP-A 5-44137, comprises polyester multifilaments 3 having a relatively large single fiber thickness, ultra-fine multifilaments 4 divided from composite multifilaments, and undivided and incompletely divided composite multifilaments 5. These three kinds of multifilaments are not bundled together, and therefore, the woven fabric has a low apparent specific gravity. Further, as a salient amount of undivided composite multifilaments remain in the woven fabric, the woven fabric has a large shear rigidity G and, when the fabric is dyed, uneven dyeing is apt to occur.

According to the method described in JP-A 2-145857, only a part of the composite filaments are dissolved out and two kinds of ultra-fine filaments, i.e., polyester filaments and polyamide filaments, are formed. The resulting woven fabric has a small volume of vacant spaces within two-layered structural yarn and the shrinkage of the woven fabric is limited, and consequently, the finally obtained woven fabric has a small apparent specific gravity.

Further, in the above-mentioned conventional methods, the fabric is subject to a crease-flexing action when the woven fabric is thermally shrunk. Therefore, strains such as creases remain in the finally obtained woven fabric with the result of reduction of the quality level. When the woven fabric is subjected to discharge printing, uneven dyeing is apt to occur.

The invention will now be specifically described by the following examples. In the examples, physical properties of a woven fabric and a filament yarn were determined by the following methods.

(1) Apparent Specific Gravity B

The apparent specific gravity B is calculated by the following formula from the average weight per unit area W ($g/cm^2$) of a woven fabric and the average thickness t (mm) thereof which are measured as follows according to JIS L 1096–1990:

$$B=W/(1{,}000\times t)$$

Three samples each having a size of 20 cm×20 cm are prepared and a weight (g) of each specimen is measured at a temperature of 20°±2° C. and a relatively humidity of 65 ±2%, and the average weight W ($g/cm^2$) is expressed in terms of a value per $m^2$. Thickness t (mm) of the woven fabric is determined by measuring the thickness (mm) using a thickness meter on five locations of each sample under an initial load of 7 $gf/cm^2$ at a temperature of 20°±2° C. and a relatively humidity of 65±2% and expressing the measured thicknesses by the average thickness in mm.

(2) Shear Rigidity G

The shear rigidity G is determined by preparing a shear characteristic graph of a woven fabric according to KES (Kawabata Evaluation System) as described in Sen-i Kikai Gakkai-shi (Japan) 26, p721 (1973) and calculating from the shear characteristic graph.

(3) Feeling and Surface Touch of Woven Fabric

Texture, surface touch, feeling and drape of a woven fabric are evaluated according to an organoleptic examination by five persons skilled in the art, and the results are expressed by five ratings A, B, C, D and E wherein A is the best and the E is the worst.

(4) Boiling Water Shrinkage

A hank of multifilaments with about 3,000 deniers is prepared and 0.1 g/de of a load is applied to the hank to measure the length (original length) $L_0$ (cm). The load applied is changed to 2 mg/de, and the hank is immersed in boiling water for 30 minutes. The hank is then dried and the load is changed to 0.1 g/de to measure the length $L_1$ (cm). The boiling water shrinkage (%) is calculated from $L_0$ and $L_1$ by the following equation:

$$\textit{Boiling water shrinkage}\ (\%)=[(L_0-L_1)/L_0]\times 100$$

EXAMPLE 1

Polyethylene terephthalate having an intrinsic viscosity of 0.64 was copolymerized with isophthalic acid, and the resulting polyester was melt-spun at a spinning speed of 3,600 m/min to give intermediately oriented polyester multifilament yarn (50 deniers/12 filaments).

An undrawn side-by-side type polyester composite multifilament yarn (90 deniers/20 filaments) having a cross-sectional shape shown in FIG. 3, each filament having an elongation of 210% and consisting of 48 segments as ingredient A and 48 segments as ingredient B, was made from ingredient A comprising polyethylene terephthalate having an intrinsic viscosity of 0.68 and containing 4% by weight of polyether-ester composed of a dicarboxylic acid ingredient and a polyoxyalkylene glycol ingredient and 4% by weight of a polyalkylene glycol having an average molecular weight of 20,000, and ingredient B comprising polyethylene terephthalate having an intrinsic viscosity of 0.64.

The intermediately oriented polyester multifilament yarn and the side-by-side type polyester composite multifilament yarn were paralleled, commingled together by an interlacing nozzle at an overfeed ratio of 1% and a compressed air pressure of 2 $kg/cm^2$, and then false-twisted at a false-twisting rate of 225 m/min and a surface speed on a false-twisting disc of 450 m/min, simultaneously with drawing at a drawing ratio of 1.4 times of the original length.

The thus-made two-layered structural yarn comprised highly shrinkable polyester multifilaments having a boiling water shrinkage of 70% and side-by-side type composite multifilaments having a boiling water shrinkage of 60%. A satin fabric with a cover factor in warp of 1,624 and a cover factor in weft of 1,126 was woven from a warp prepared by Z-twisting the two-layered structural yarn at a twist number of 330 T/m and a weft prepared by S-twisting the two-layered structural yarn at a twist number of 100 T/m. The satin woven fabric exhibited a shrinkage initiation temperature Ts of 52° C.

The satin woven fabric was immersed in an aqueous sodium hydroxide solution having a concentration of 100 g/l at 50° C. by using a jigger dyeing machine whereby the readily soluble ingredient A of the composite multifilaments was dissolved out to form ultra-fine multifilaments. The alkali-treated woven fabric was neutralized and then heat-shrunk in a widespread state by using an open soaper whereby the surface area of the fabric was shrunk by 42%. The heating temperature was 62° C. at the inlet, was elevated gradually from the inlet to the outlet and was 95° C. at the outlet.

The woven fabric was then subjected to a crease-flex treatment at 130° C. by using a circular dyeing machine, dried, and then, buffed and dyed according to the conventional procedure. The surface of the thus treated woven fabric was covered with fluffs of flat-shaped ultra-fine polyester multifilaments with a flatness of 11 and a single fiber thickness of 0.05 denier. The cross-section of the woven fabric was similar to that shown in FIG. 1. The apparent specific gravity B was 0.45 and the shear rigidity G was 0.51. The woven fabric had an enhanced close and tight texture, and had soft surface touch and feeling, which were comparable with natural nubuck. Uneven dyeing was not observed.

EXAMPLES 2 TO 9 AND COMPARATIVE EXAMPLES 1 and 2

Satin woven fabrics were made and treated by the same procedures as described in Example 1 to make nubuck-like woven fabrics except that the shape and amount of ingredient A and ingredient B of the side-by-side and/or islands-in-sea type composite filaments were varied to form ultra-fine polyester multifilaments having a single fiber thickness and flatness, which were shown in Table 1. The results are shown in Table 1.

TABLE 1

| | Ultra-fine filaments | | Apparent | Shear | |
|---|---|---|---|---|---|
| | Single fiber thickness (d) | Flatness | specific gravity B | rigidity G (gf/cm.deg) | Feeling |
| Comp. Ex. 1 | 0.0008 | 11 | 0.72 | 0.19 | D |
| Example 2 | 0.001 | 11 | 0.69 | 0.22 | B |
| Example 3 | 0.01 | 11 | 0.60 | 0.41 | A |
| Example 4 | 0.1 | 11 | 0.43 | 0.88 | A |
| Example 5 | 0.5 | 11 | 0.36 | 1.47 | B |
| Comp. Ex. 2 | 0.6 | 11 | 0.33 | 1.53 | E |
| Example 6 | 0.05 | 1 | 0.38 | 1.41 | B |
| Example 7 | 0.05 | 8 | 0.41 | 0.86 | A |
| Example 8 | 0.05 | 15 | 0.53 | 0.40 | A |
| Example 9 | 0.05 | 17 | 0.68 | 0.33 | B |

As seen from Table 1, when the apparent specific gravity is in the range of 0.5 to 1.0 and the shear rigidity G is in the range of 0.5 to 1.0 gf/cm·deg (Examples 2 to 9), nubuck-like woven fabrics having a close and tight texture, and soft surface touch and feeling can be obtained. When the ultra-fine multifilaments have a single fiber thickness of 0.01 to 0.1 denier and a flatness of 8 to 15 (Examples 3, 4, 7 and 8), better results could be obtained.

When the ultra-fine multifilaments have a single fiber thickness smaller than 0.01 denier (Comparative Example 1), the surface touch and feeling of the woven fabric are too soft, i.e., the woven fabric has a limp and rubbery feeling.

When the ultra-fine multifilaments have a single fiber thickness larger than 0.5 denier (Comparative Example 2), the woven fabric have stiff touch and feeling and do not exhibit a close and tight texture.

EXAMPLES 10 TO 12

The same intermediately oriented polyester multifilament yarn as that prepared in Example 1 and the same undrawn side-by-side type polyester composite multifilament yarn as that prepared in Example 1 were drawn and heat-treated, and then were commingled together by feeding the intermediately oriented polyester multifilament yarn and the composite multifilament yarn to an interlacing nozzle at overfeed ratios of 1% and 3%, respectively, and a compressed air pressure of 2 kg/cm$^2$, to prepare a two-layered structural yarn.

The thus prepared two-layered structural yarn comprised highly shrinkable polyester multifilaments having a boiling water shrinkage of 50% and side-by-side type composite multifilaments having a boiling water shrinkage of 40%. The two-layered structural yarn was then woven into a satin fabric by the same procedure as that described in Example 1. The satin fabric had a shrinkage initiation temperature Ts of 58° C.

The satin fabric was then immersed in an aqueous sodium hydroxide solution having a concentration of 100 g/l at a temperature shown in Table 2 by using a jigger dyeing machine whereby the readily soluble ingredient A of the composite multifilaments was dissolved out to form ultra-fine multifilaments. The alkali-treated woven fabric was neutralized and then heat-shrunk in a widespread state at a temperature shown in Table 2 by using an open soaper. The woven fabric was then subjected to a crease-flex treatment at 130° C. by using a circular dyeing machine, dried, and then, buffed and dyed according to the conventional procedure.

The results are shown in Table 2.

TABLE 2

| | Dissolution temperature (°C.) | Shrinkage (%) | Apparent specific gravity B | Shear rigidity G (gf/cm.deg) | Feeling |
|---|---|---|---|---|---|
| Example 10 | 55 | 15 | 0.35 | 1.21 | C |
| Example 11 | 55 | 22 | 0.38 | 0.89 | B |
| Example 12 | 55 | 37 | 0.41 | 0.67 | A |

As seen from Table 2, when the woven fabric is shrunk by 20% or more, the woven fabric exhibits a close and tight texture and soft surface touch and feeling. When the woven fabric is shrunk by 35% or more, better results are obtained. In contrast, when the woven fabric is shrunk by smaller than 20%, the texture of the fabric is somewhat poor in closeness and tightness.

COMPARATIVE EXAMPLE 3

By the same procedures as those employed in Example 1, a woven fabric was made and treated except that, prior to the partial dissolution treatment, the woven fabric was scoured at 80° C., relaxed in boiling water and subjected to a pre-setting treatment at 180° C., and the partial dissolution treatment was conducted by immersing the woven fabric in boiling aqueous sodium hydroxide solution. All other conditions remained the same.

The resulting woven fabric had a cross-section similar to that shown in FIG. 2. The apparent specific gravity B was 0.25 and the shear rigidity G was 1.67. The woven fabric exhibited partly uneven dyeing and had partly stiff surface touch. The texture of the fabric was poor in closeness and tightness and the quality level was low.

COMPARATIVE EXAMPLE 4

By the same procedures as those employed in Example 1, a woven fabric was made and treated except that, after the partial dissolution treatment, the thermal shrinking treatment of the woven fabric under a widespread state was not conducted, and the woven fabric was subjected to a crease-flex treatment at 120° C. by using a circular dyeing machine, followed by drying, buffing and dyeing. All other conditions remained the same.

The resulting woven fabric had an apparent specific gravity B of 0.34 and a shear rigidity G of 1.48. Crease strain caused by the crease-flexing treatment remained in the woven fabric. The texture of the fabric was poor in closeness and tightness and the quality level was low.

REFERENCE EXAMPLE

For comparison, the apparent specific gravity B and shear rigidity G of a commercially available nubuck type woven fabric (which was made by a process including a step of impregnation with a polyurethane resin) was evaluated. The apparent specific gravity B was 0.28 and the shear rigidity G was 3.93.

INDUSTRIAL APPLICABILITY

The nubuck-like woven fabric of the present invention is uniform, exhibits a close and tight texture and has soft surface touch and feeling. Therefore, this nubuck-like woven fabric is useful, for example, as a jacket, a blouson and a coat.

According to the method of the present invention, a nubuck-like woven fabric which is uniform, has a close and tight texture, and soft surface touch and feeling, is obtained.

We claim:

1. A nubuck-like woven fabric comprising a two-layered structural yarn wherein ultra-fine polyester multifilaments having a single fiber thickness of 0.001 to 0.5 denier are primarily disposed in a sheath portion and polyester multifilaments having a single fiber thickness larger than that of the ultra-fine polyester multifilaments are primarily disposed in a core portion; said woven fabric satisfying the following two requirements (1) and (2):

(1) the woven fabric has an apparent specific gravity B of 0.35 to 0.7 as calculated by the following formula from the weight per unit area W (g/m$^2$) and thickness t (mm) of the woven fabric which are measured as follows according to JIS-L 1096-1990:

$$B=W/(1{,}000\times t)$$

wherein the weight per unit area W (g/m$^2$) of the woven fabric is determined by weighing the weight (g) of three specimens each having a size of 20 cm×20 cm at a temperature of 20°±2° C. and a relative humidity of 65±2%, and the average weight is expressed in terms of a value per m$^2$, and the thickness t (mm) of the woven fabric is determined by measuring the thickness (mm) using a thickness meter on five locations of each specimen under an initial load of 7 gf/cm$^2$ at a temperature of 20°±2° C. and a relative humidity of 65±2% and expressing the average thickness in mm; and (2) the woven fabric has a shear rigitity G of 0.2 to 1.5 gf/cm·deg as measured by the shear testing method according to KES (Kawabata Evaluation System).

2. A nubuck-like woven fabric as claimed in claim 1, wherein the ultra-fine polyester multifilaments have a flat cross-section with a flatness of 8 to 15.

3. A nubuck-like woven fabric as claimed in claim 1, wherein the two-layered structural yarn is a false-twisted composite yarn.

4. A nubuck-like woven fabric as claimed in claim 1, wherein the woven fabric is colored by a printing method.

5. method of producing a nubuck-like woven fabric characterized in that:

(1) a woven fabric comprising a two-layered structural yarn prepared by commingling (i) side-by-side type composite multifilaments and/or islands-in-sea type composite multifilaments comprising (a) a readily soluble ingredient and (b) an ingredient having a solubility smaller than that of ingredient (a) and capable of forming ultra-fine polyester multifilaments, together with (ii) highly shrinkable polyester multifilaments having a thermal shrinkage larger than that of the composite multifilaments (i), is subjected to a partial dissolution treatment for dissolving the readily soluble ingredient (a) without substantial shrinkage of the two-layered structural yarn thereby to remove the ingredient (a) from the composite multifilaments (i) whereby ultra-fine polyester multifilaments with a flat cross-section are formed; and then, (2) the thus-treated woven fabric is subjected to a shrinking treatment in a widespread state.

6. A method of producing a nubuck-like woven fabric as claimed in claim 5, wherein the partial dissolution treatment for dissolving the readily soluble ingredient (a) is effected at a temperature lower than the shrinkage initiation temperature Ts of the woven fabric, wherein the shrinkage initiation temperature Ts means a temperature at which areal shrinkage S of the woven fabric, represented by the following formula, reaches at least 10% when the woven fabric is thermally shrunk in a free state at a temperature elevating rate of 2° C./minute:

$$\text{Areal shrinkage } S\ (\%) = (1 - [\text{surface area of fabric after thermal shrink/surface area of fabric before thermal shrink}]) \times 100.$$

7. A method of producing a nubuck-like woven fabric as claimed in claim 5, wherein the shrinking treatment of the woven fabric is effected to an extent such that the areal shrinkage of the woven fabric is at least 20%.

8. A method of producing a nubuck-like woven fabric as claimed in claim 5, wherein the two-layered structured yarn is a false-twisted composite yarn.

9. A method of producing a nubuck-like woven fabric as claimed in claim 5, wherein the readily soluble ingredient (a) is composed of a polyether-ester derived from a dicarboxylic acid ingredient and a polyoxyalkylene glycol ingredient, and a polyester containing a polyoxyalkylene glycol.

10. A method of producing a nubuck-like woven fabric as claimed in claim 5, wherein the woven fabric shrunk in a widespread state is further subjected to a crumpling treatment.

11. A method of producing a nubuck-like woven fabric as claimed in claim 5, wherein the woven fabric shrunk is further subjected to a raising treatment whereby the ultra-fine polyester multifilaments are fluffed to render the fabric surface fluffy.

* * * * *